US009445644B2

(12) United States Patent
Cressman et al.

(10) Patent No.: US 9,445,644 B2
(45) Date of Patent: Sep. 20, 2016

(54) FOOTWEAR WITH SLIDING CAP

(71) Applicants: Sylvia G. Cressman, North Canton, OH (US); Emily A. Czubaj, North Canton, OH (US); Kate A. Lochridge, North Canton, OH (US); Eleanor M. Plaster, North Canton, OH (US); Nicole J. Tysa, North Canton, OH (US); Caitlin M. Zollinger, North Canton, OH (US)

(72) Inventors: Sylvia G. Cressman, North Canton, OH (US); Emily A. Czubaj, North Canton, OH (US); Kate A. Lochridge, North Canton, OH (US); Eleanor M. Plaster, North Canton, OH (US); Nicole J. Tysa, North Canton, OH (US); Caitlin M. Zollinger, North Canton, OH (US)

( * ) Notice: Subject to any disclaimer, the term of this patent is extended or adjusted under 35 U.S.C. 154(b) by 278 days.

(21) Appl. No.: 14/153,523

(22) Filed: Jan. 13, 2014

(65) Prior Publication Data

US 2014/0123516 A1 May 8, 2014

Related U.S. Application Data

(60) Provisional application No. 61/751,544, filed on Jan. 11, 2013.

(51) Int. Cl.

| | |
|---|---|
| ***A43B 5/00*** | (2006.01) |
| ***A43C 11/00*** | (2006.01) |
| ***A43B 9/00*** | (2006.01) |
| ***A43B 1/00*** | (2006.01) |
| ***A43B 11/00*** | (2006.01) |
| ***A43C 11/12*** | (2006.01) |

(52) U.S. Cl.

CPC ..... *A43B 9/00* (2013.01); *A43B 1/0054* (2013.01); *A43B 1/0081* (2013.01); *A43B 11/00* (2013.01); *A43C 11/008* (2013.01); *A43C 11/12* (2013.01)

(58) Field of Classification Search

CPC .... A43B 11/00; A43B 11/02; A43B 1/0054; A43B 5/00; A43B 9/00; A43C 11/00; A43C 11/008

USPC ..... 36/97, 100, 138, 50.1

See application file for complete search history.

(56) References Cited

U.S. PATENT DOCUMENTS

| | | | | |
|---|---|---|---|---|
| 4,120,103 | A * | 10/1978 | Colby | A43B 3/26 36/130 |
| 4,665,634 | A | 5/1987 | Diaz | |
| 5,282,327 | A * | 2/1994 | Ogle | A43B 11/00 36/105 |
| 5,460,600 | A * | 10/1995 | Bieling | A61F 5/0585 128/882 |
| 5,659,980 | A * | 8/1997 | Lin | A43B 3/30 36/105 |
| 6,880,270 | B2 * | 4/2005 | Prather | A41F 1/002 24/303 |
| 7,127,837 | B2 | 10/2006 | Ito | |
| 7,793,438 | B1 * | 9/2010 | Busse | A43B 11/02 36/105 |
| 8,065,819 | B2 * | 11/2011 | Kaufman | A43C 11/008 36/122 |
| 8,161,669 | B2 | 4/2012 | Keating | |
| 8,499,474 | B2 * | 8/2013 | Kaufman | A43C 11/00 36/138 |
| 2005/0268495 | A1 * | 12/2005 | Schenone | A43B 3/0078 36/100 |

* cited by examiner

*Primary Examiner* — Jila M Mohandesi

(74) *Attorney, Agent, or Firm* — Zollinger & Burleson Ltd.

(57) ABSTRACT

An item of footwear has first and second portions that slide with respect to each other to allow the user to easily put the footwear on and take the footwear off. The footwear may be opened and closed without requiring the user to bend over and manipulate closure mechanisms with his hands. The footwear allows a person's foot to be readily inserted and removed from the footwear when the footwear is open while being secured within the footwear when the footwear is closed.

15 Claims, 16 Drawing Sheets

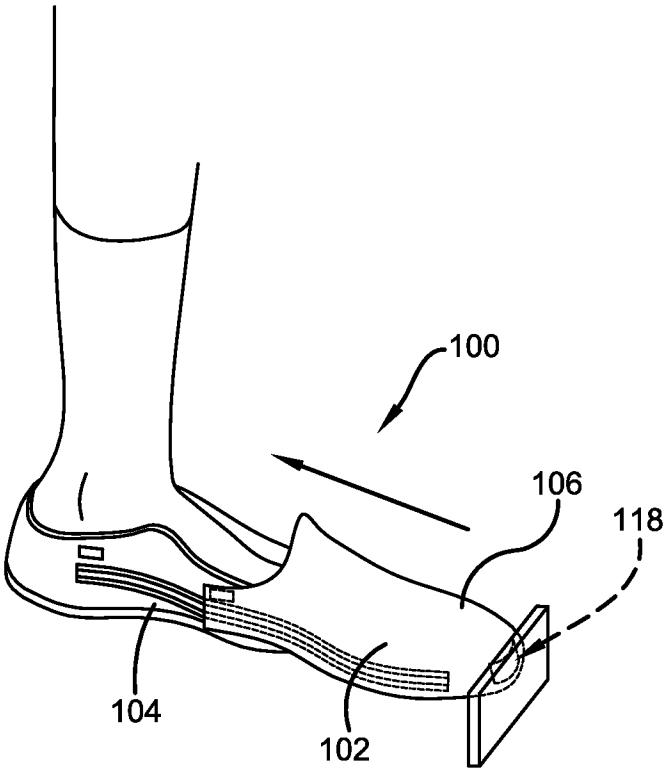
FIG. 1C
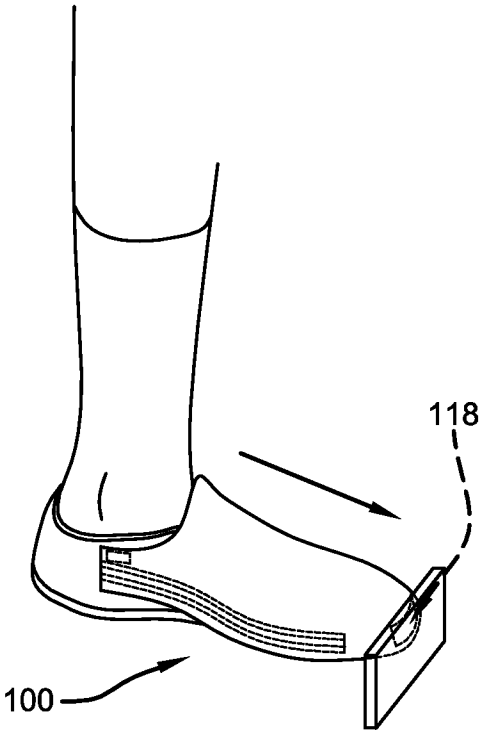

D-D

E-E

A-A

FOOTWEAR WITH SLIDING CAP

CROSS REFERENCE TO RELATED APPLICATIONS

This application claims the benefit of U.S. Provisional Patent Application Ser. No. 61/751,544 filed Jan. 11, 2013; the disclosures of which are incorporated herein by reference.

BACKGROUND OF THE DISCLOSURE

1. Technical Field

The present disclosure relates to footwear and more particularly to the improvement of the installation of footwear on the feet of individuals that have limited ability to install footwear with standard fastening mechanisms that require that a person bend over to install the footwear.

2. Background Information

Different footwear configurations are known for use by persons who have difficulties manipulating traditional laces or other closure mechanisms such as zippers and hook-and-loop fasteners. Such traditional closure mechanisms include ties, zippers, elastic ties, and hook-and-loop fasteners. While these traditional fastening mechanisms are adequate for those that have the flexibility and dexterity to manipulate the fastening mechanism, these mechanisms are challenging for those who cannot easily bend down to reach their feet and for those who lack the manual dexterity to manipulate the mechanisms. Frustration and difficulties with putting on footwear leads to less walking for the individual which can lengthen a recovery. The industry lacks footwear designs that provide a method of installing the footwear without using the hands for installation.

SUMMARY OF THE DISCLOSURE

The disclosure provides an item of footwear that has first and second portions that slide with respect to each other to allow the user to easily put the footwear on and take the footwear off. The footwear may be opened and closed without requiring the user to bend over and manipulate closure mechanisms with his hands. The footwear of this disclosure allows a person's foot to be readily inserted and removed from the footwear when the footwear is open while being secured within the footwear when the footwear is closed.

A variety of different configurations may be used to open and close the footwear along with a variety of mechanisms to hold the footwear closed. One exemplary configuration uses a shoe cap that slides back and forth on a shoe base. Magnets are used to hold the cap in the closed position and a hook or magnet configuration is used to hold the shoe cap in place while the shoe base is pulled away from the shoe cap to an open condition.

BRIEF DESCRIPTION OF THE DRAWINGS

FIGS. 1A-1D depict an exemplary configuration of the footwear being put on and then taken off by an individual.

Similar numbers refer to similar parts throughout the specification.

DETAILED DESCRIPTION OF THE DISCLOSURE

Figure 1A:
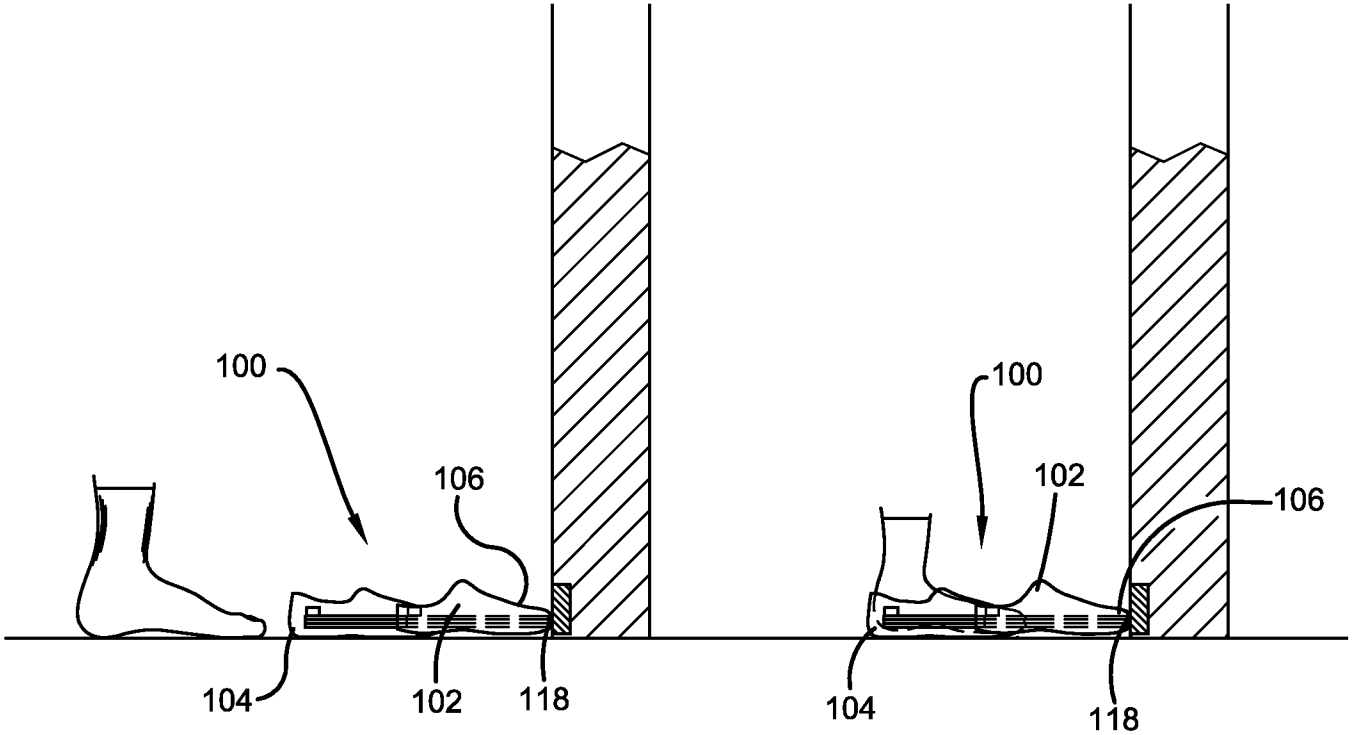

An exemplary configuration of the footwear is depicted in the form of a shoe 100 and a method for using shoe 100 is depicted in FIGS. 1A through 1D. On the left side of FIG. 1A, shoe 100 is in the open condition with a shoe cap 102 slid forward with respect to a shoe base 104. The right side of FIG. 1A depicts the user's foot placed down onto the foot bed defined by shoe base 104. The user can place his or her foot directly down onto the foot bed of base 104 with little or no pivoting of the foot because shoe cap 102 is slid far enough forward to expose a substantial portion (in some embodiments the entire portion) of the foot bed defined by base 104. This open condition allows the user's foot to be placed on shoe base 104 without requiring the user to hold shoe 100 with the user's hands. This can be accomplished while the user is standing or sitting. In the open condition, shoe cap 102 exposes at least fifty percent of the foot bed defined by shoe base 104 and in some cases an exposure of over seventy-five percent or ninety percent is desired. In one configuration, the entire foot bed is exposed so the foot can be placed directly down on the foot bed. The open position of cap 102 makes it very easy for the user to place the foot onto the foot bed without the need for the user to grasp a portion of shoe 100 and pivot the shoe, stretch the shoe, bend the shoe, hold the shoe, or otherwise manipulate shoe 100 while the foot is being placed onto the foot bed. This is desirable by those persons who have trouble bending over and reaching their shoes, for those who have difficulties manipulating objects with their hands, and for arm or hand amputees.

Figure 1B:
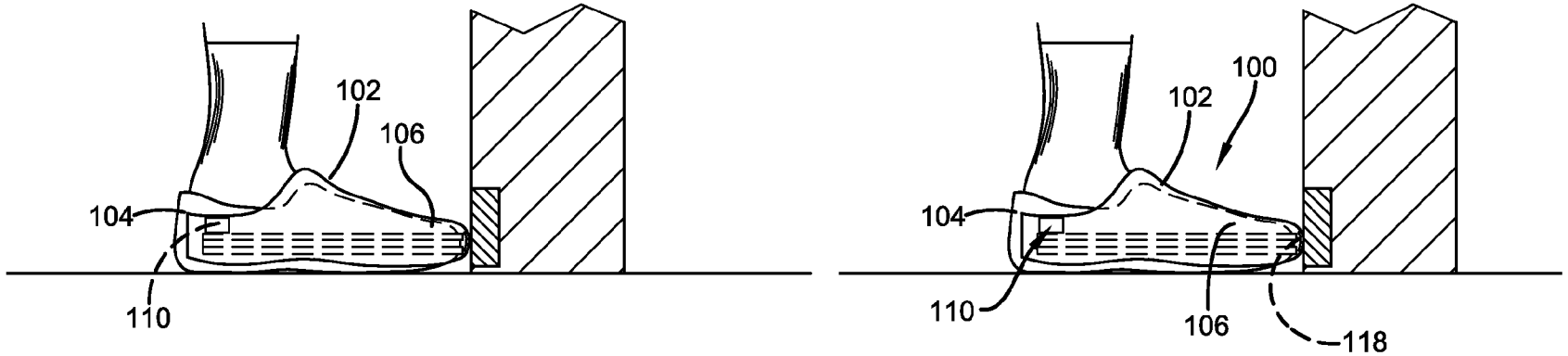
Figure 1D:
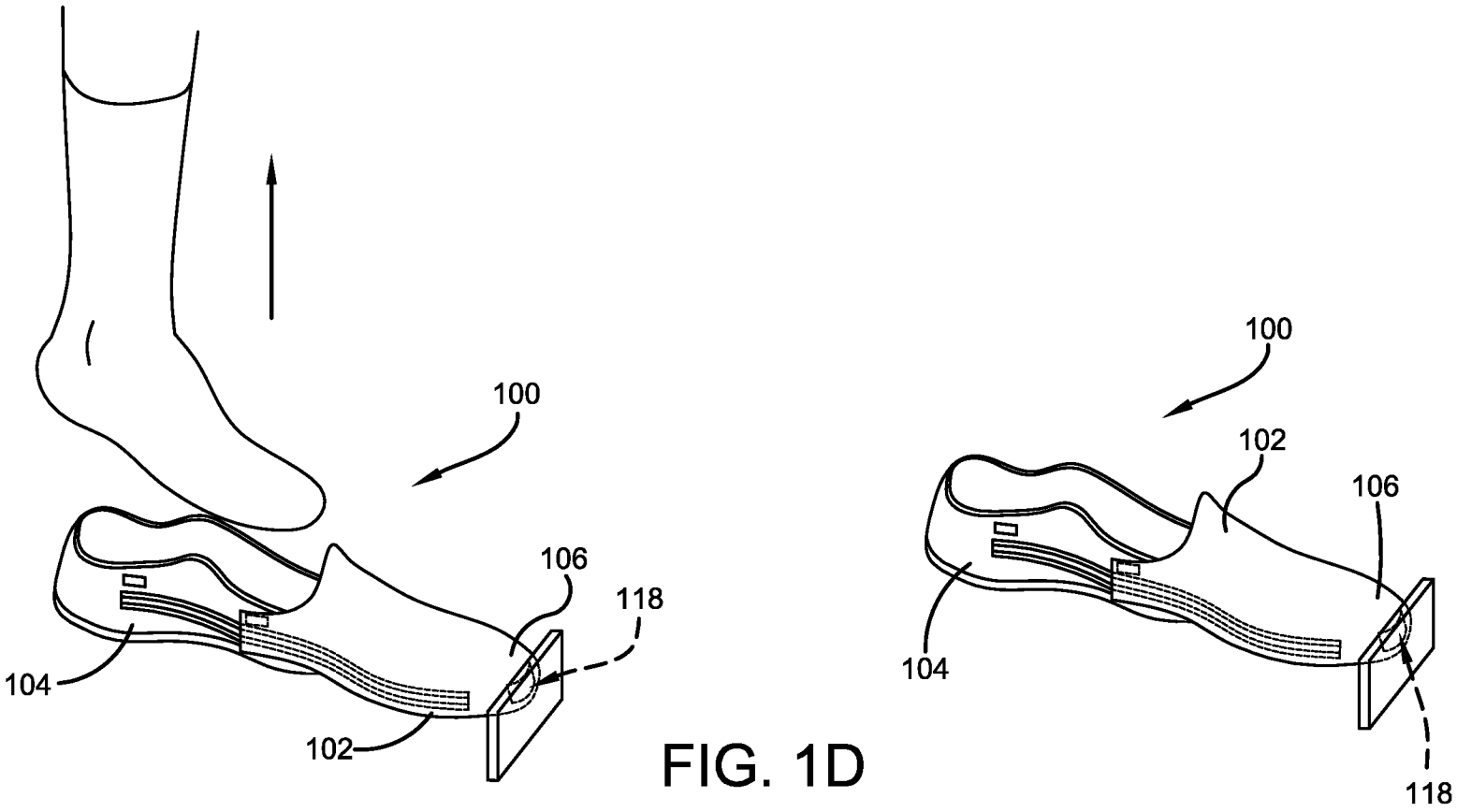
Figure 13:
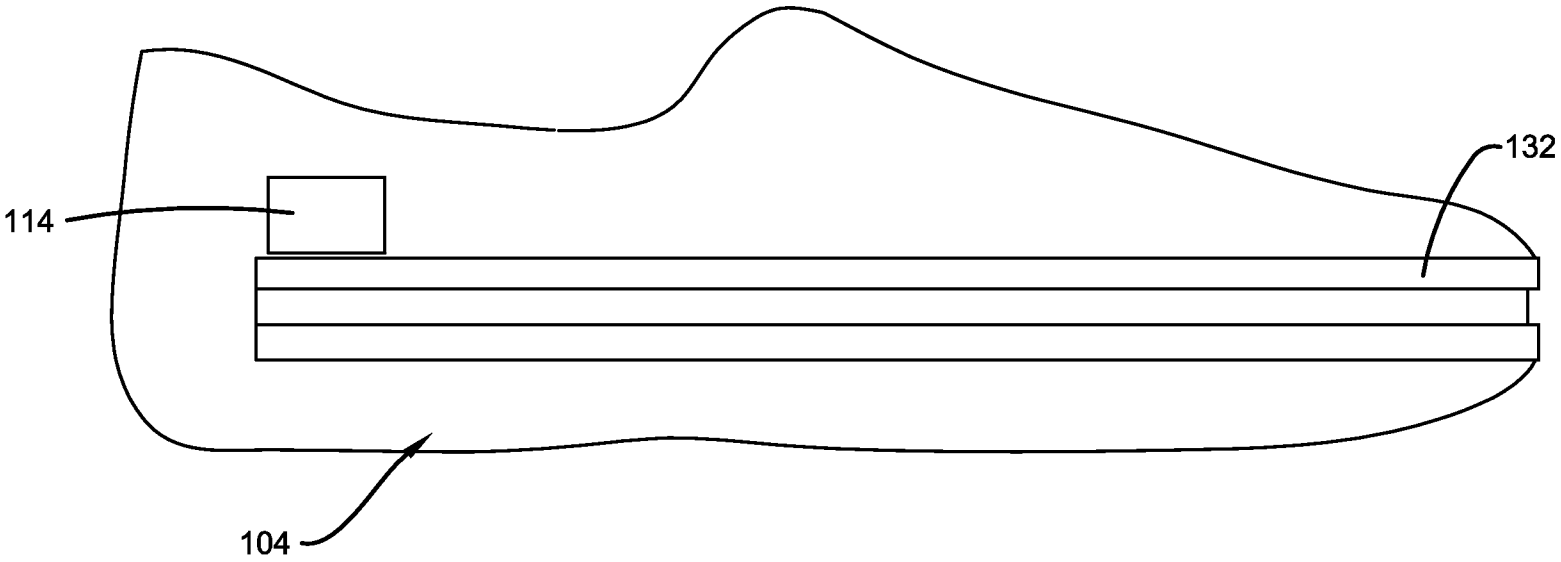
FIG. 13 is a side view of the shoe base.

The user closes shoe 100 in the manner depicted in FIG. 1B by generating a closing force on the toe box 106. This closing force can be created by the user's leg pushing the user's foot and shoe 100 against an object (such as the wall depicted in FIGS. 1A-1D) wherein shoe base 104 and the user's foot slide forward with respect to shoe cap 102 until shoe base 104 reaches its closed position as shown in FIG. 1B. The object may be a wall (as shown in FIG. 1), a furniture leg, or another object that will not readily move when pushed by the user's leg to close shoe 100. The closing force may be generated by a quick kicking motion or a slower sustained pushing motion. As shown in FIG. 13, shoe base 104 has a perimeter wall disposed in front of the user's toes so that the user can generate a closing force by pushing against shoe base 104.

Shoe base 104 is closed in the forward direction which is from the heel of shoe 100 toward the toe box 106 (FIG. 1B). Shoe 100 is fully closed when a latching mechanism 110 engages to hold shoe cap 102 in position with respect to shoe base 104. In the exemplary configuration, latching mechanism 110 includes magnets 112 disposed near or at the rear of shoe cap 102 and magnets 114 carried by shoe base 104. When shoe cap 102 is moved rearwardly relative to shoe base 104, magnets 112 move close to magnets 114 where they attract each other and connect together (with or without a layer or layers of material disposed between magnets 112 and 114) to hold shoe cap 102 in the closed and latched condition. In other configurations of shoe 100, latching mechanism 110 may be provided in a form with only one set of magnets 112 or 114 used with slugs of ferrous material to which magnets 112 or 114 attract and connect. In another exemplary configuration, latching mechanism 110 uses a mechanical force to hold shoe cap 102 closed. This mechanical force may be created by hooks and latches, snaps, portions that form an interference fit, or hook-and-loop fasteners. The latching mechanism may include any of a variety of elements that automatically engage when shoe cap 102 is pushed rearwardly. The latching mechanism used in this embodiment is releasable.

Shoe 100 may be configured to tighten or clamp against the user's foot when shoe 100 is moved to the closed condition. In this way, shoe 100 is similar to traditional shoes that can be tightened by pulling on laces or other traditional fastening mechanisms. The tightening may be accomplished through the configuration of the track such as making the track ends closest to the heel closer together than near the toe to cause shoe cap 102 to squeeze together as it moves back toward the closed position. In addition, one or both of shoe cap 102 and shoe base 104 may be custom-molded for the user's foot so a snug secure fit is provided. Further, secondary tightening mechanisms may be provided in shoe cap 102 to provide adjustments for the shoe cap for the particular user. For example, shoe cap 102 may be provided in sections that are secured together but adjustable so that the user may select a fit for the user's foot.

Shoe 100 may be removed by the user without requiring the user to bend over and without requiring the user to manipulate mechanisms with his hands to open shoe 100. In one exemplary configuration, toe box 106 of shoe 100 carries a magnet 118. Magnet 118 is used to hold shoe cap 102 to a ferrous item to allow the user to pull back on shoe 100 to open shoe 100. Magnet 118 is configured to have a holding force that is stronger than latching mechanism 110. In another exemplary configuration, toe box 106 carries a slug of ferrous material (at location 118) at toe box 106. This slug is used with a shoe-opening magnet installed at a location where the user typically removes his shoes—such as a baseboard next to a chair or a bed. FIGS. 1C and 1D depict how the exemplary configuration is opened and how the user's foot is removed. In the closed position, toe box 106 with magnet 118 is brought into engagement with a metal surface 120 (or a specially-installed shoe opening magnet) disposed on or that has been installed on a stable item (such as a wall or table leg). When the user connects magnet 118 to the metal surface through magnetic force, the magnetic force is strong enough to overcome latching mechanism 110 when the user pulls his foot straight back. This unlatches mechanism 110 and causes shoe cap 102 to remain in place while shoe base 104 is moved rearwardly to open shoe 100. The user's foot may then be removed from shoe 100 (FIG. 1*d*). Pivoting shoe 100 away from the wall is one way of detaching shoe 100 from the wall.

In other configurations, electromagnets may be used with proximity or pressure sensors to turn on and turn off the magnetic forces. Actuators (electronic cylinders, motors, screws) may be used to move shoe cap 102 back and forth.

Shoe cap 102 also may be opened by the person wearing shoe 100 or by a third person by grasping shoe cap 102 and pulling it forward.

As noted above, the positions of magnet 118 and the ferrous surface may be reversed. In another configuration, both items may be magnets configured to attract each other.

In still another configuration, toe box 106 and the unlocking mechanism connected to the stable item (such as a wall) are in the form of a hook and latch combination which allows the user to latch toe box 106 to the unlocking mechanism to create the holding force to open shoe 100.

The Shoe Assembly

Figure 2A:
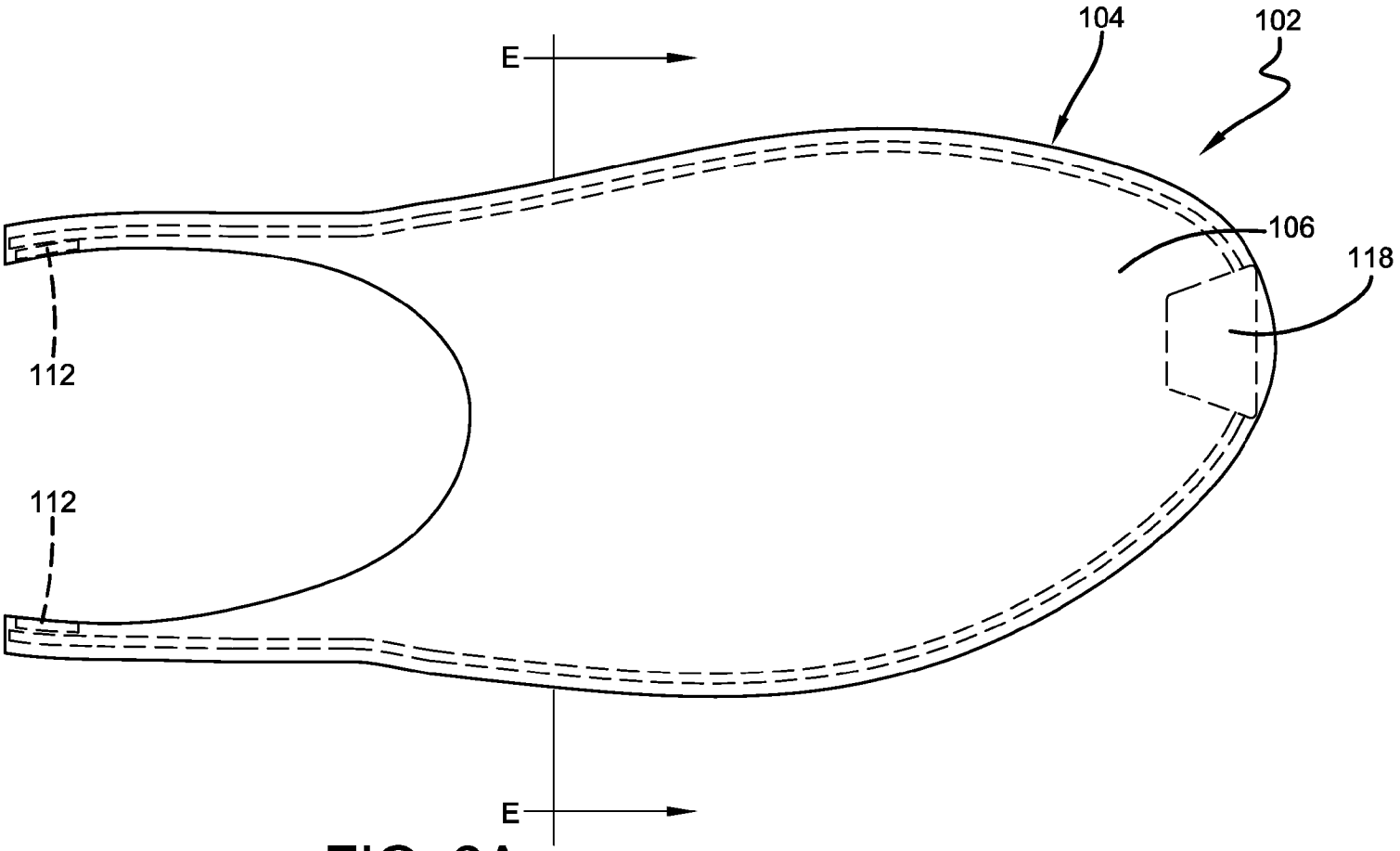
FIG. 2A is a top view of the shoe cap.
Figure 2B:
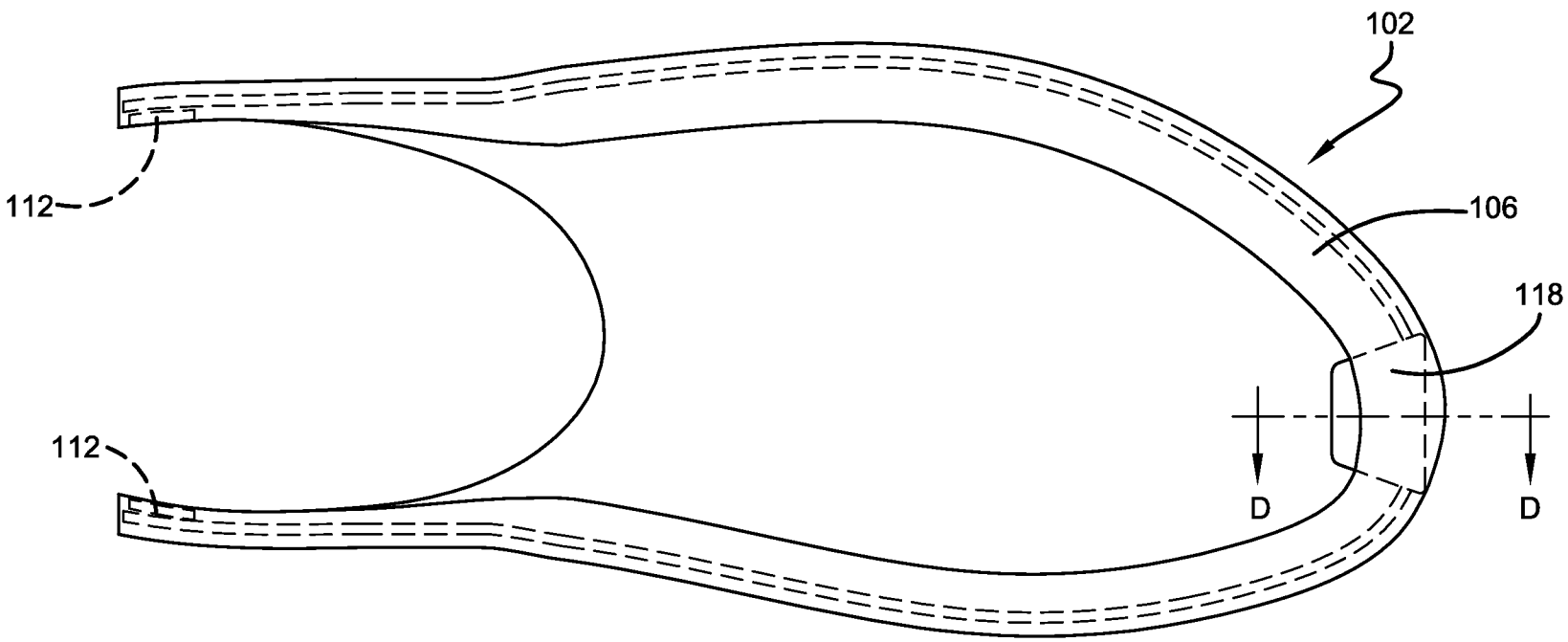
FIG. 2B is a bottom view of the shoe cap.
Figure 5:
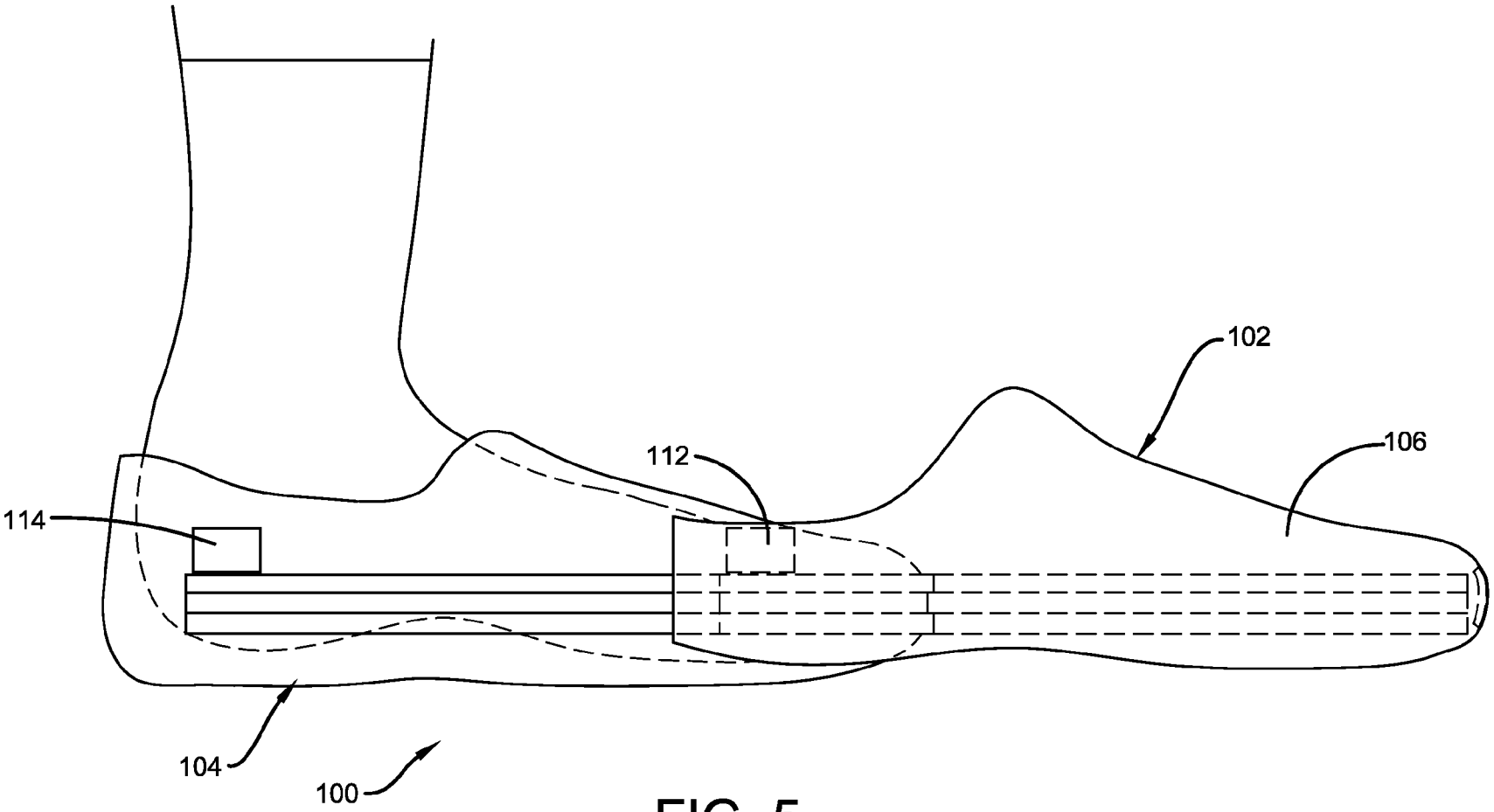
FIG. 5 is a right side view of an exemplary footwear assembly in the open condition.
Figure 12:
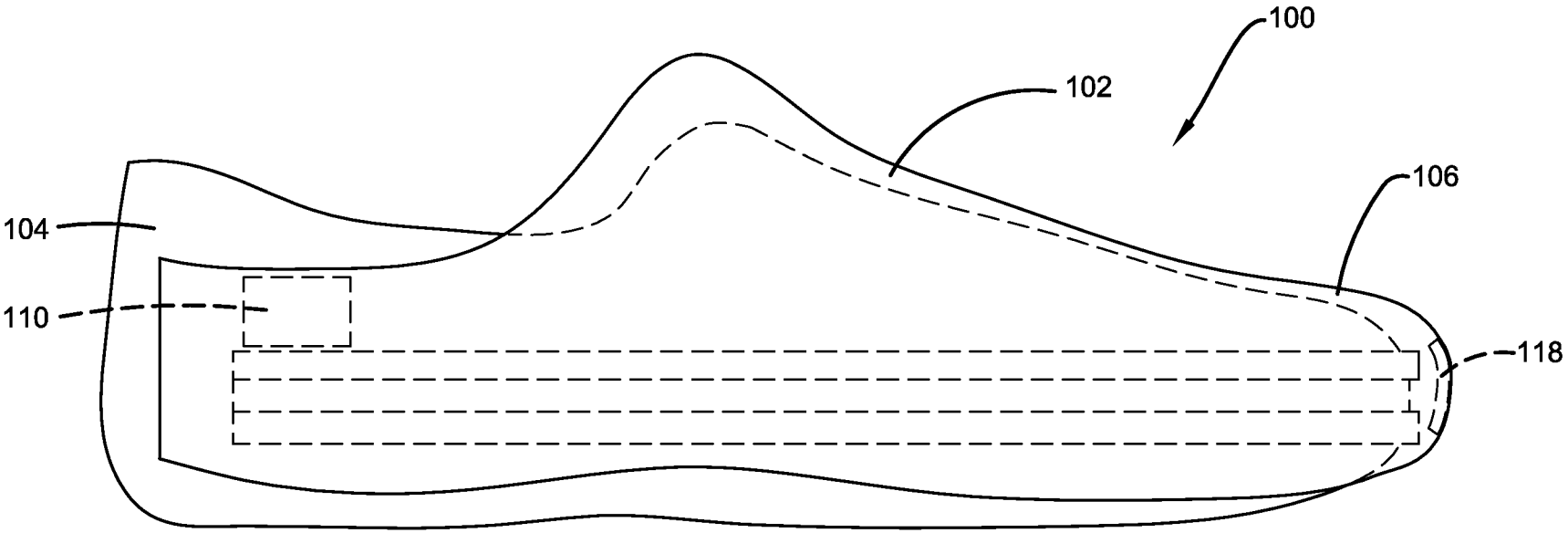
FIG. 12 is view of the right side of the footwear in the closed condition.

Shoe 100 includes upper shoe cap 102 that is carried by lower shoe base 104 (FIG. 12 and FIG. 5). In one example, shoe cap 102 (FIG. 2A and FIG. 2B) is movable along a linear path from open to closed and from closed to open positions to encapsulate a human foot that rests on the shoe base (FIG. 5 and FIG. 12). Although the entire shoe cap 102 moves along an overall linear path, the individual elements of shoe cap 102 may follow curved paths. In another example, shoe cap 102 moves back and forth along a path but also rises upwardly as shoe cap 102 moves toward the open position.

Shoe cap 102 is connected to shoe base 104 with a track and follower mechanism that allow shoe cap 102 and shoe base 104 to slide with respect to each other. When closed, shoe 100 may include a rib that fits within a portion of the track to seal shoe 100 closed.

Figure 9:
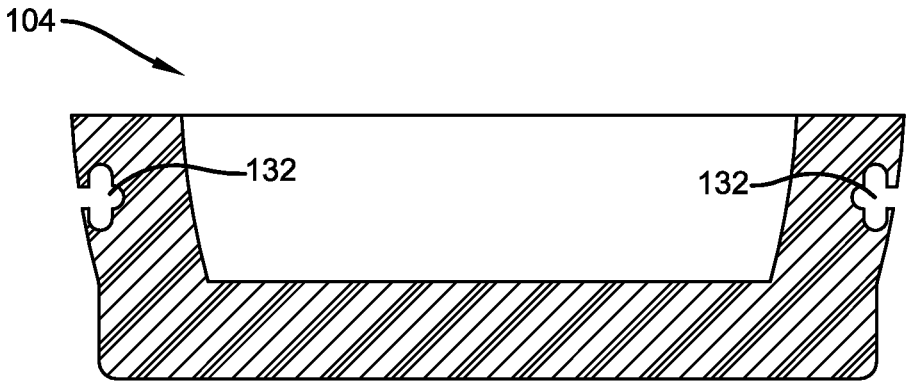
FIG. 9 is a view taken along line A-A of FIG. 8.
Figure 10:
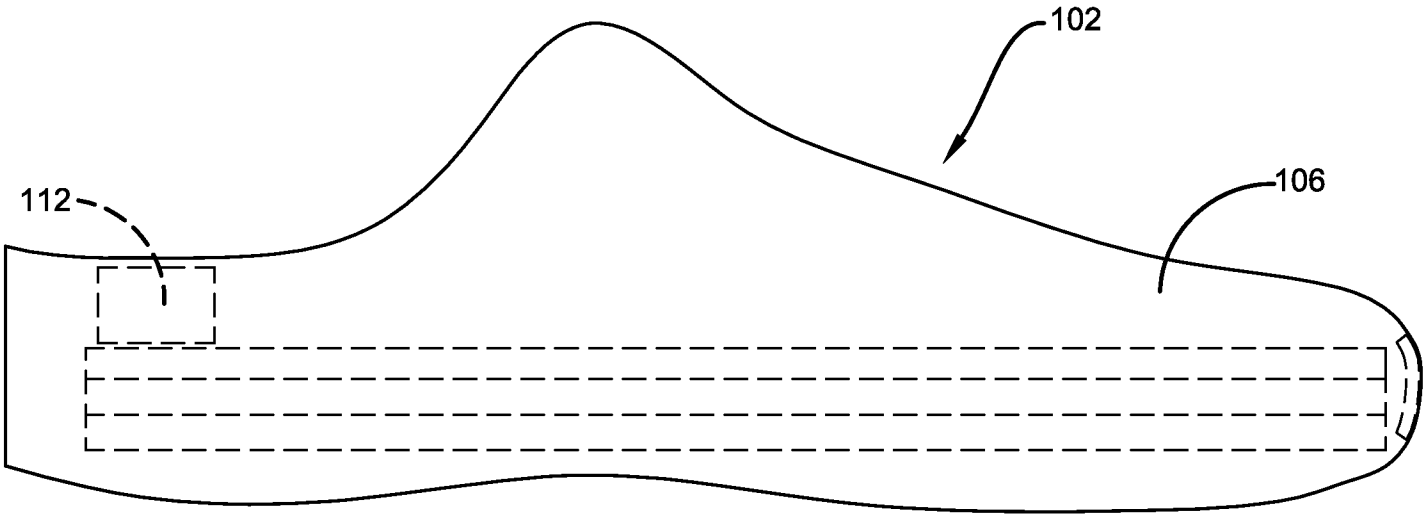
FIG. 10 is a right side view of the shoe cap.
Figure 11:
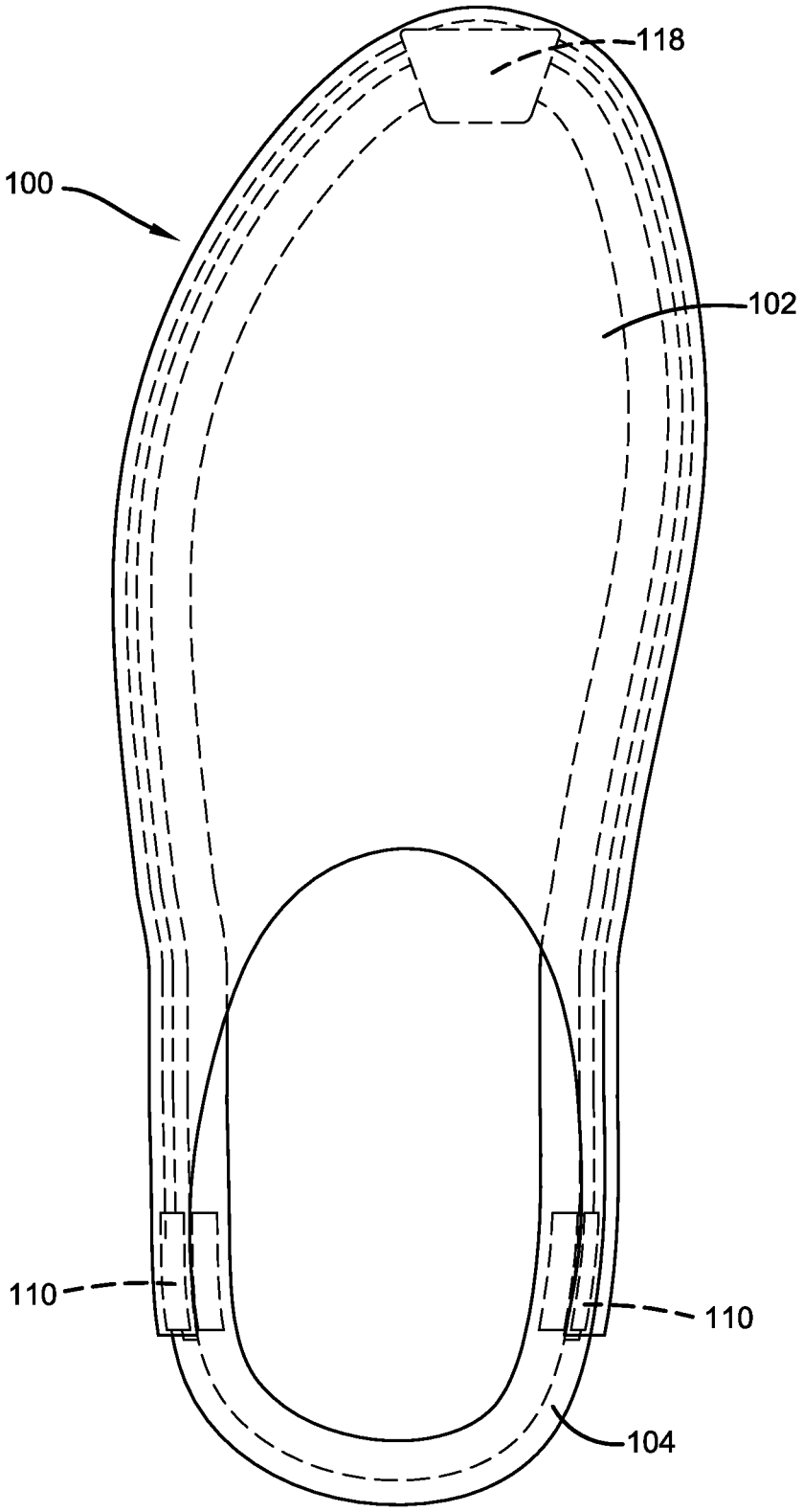
FIG. 11 is a top view of the footwear in the closed condition.
Figure 14:
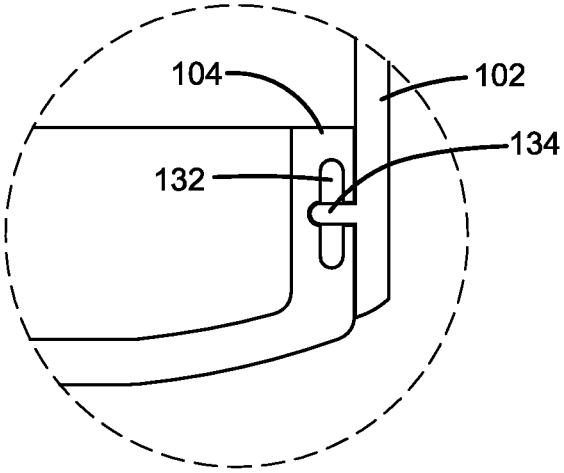
FIG. 14 is a view of the latching rib inserted in the track.
Figure 15:
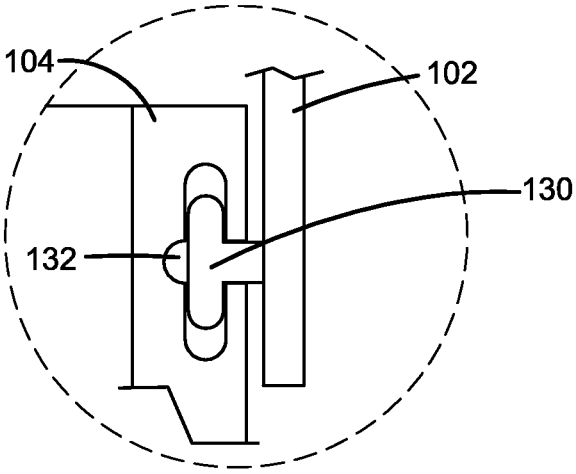
FIG. 15 is view of a track follower in a track.

In the exemplary configuration, shoe cap 102 includes a pair of track followers 130 (FIG. 7) disposed on the sides of shoe cap 102. Each track follower 130 extends into a slot defined by a track 132 carried by or integrally defined by shoe base 104 (FIGS. 9, 14, and 15). The positions of track follower 130 and track 132 may be reversed such that track 132 is defined by shoe cap 102.

Each track follower 130 may be a short peg-like structure, a wheel, a fixed finger, or an elongated slider. Followers 130 may be flexible or rigid as needed. Elongated followers 130 help provide stability to shoe 100 but limit the configuration of track 132. Short track followers 130 allow track 132 to define curves. Shoe cap 102 remains connected to shoe base 104 throughout the entire movement of shoe cap 102 from its full-open to full-closed positions (FIG. 5). The sliding motion of shoe cap 102 is between shoe cap 102 and shoe base 104 even though track followers 130 may rotate or pivot with respect to track 132.

Toe box 106 of shoe cap 102 has a latching rib 134 that interconnects shoe cap 102 and shoe base 104 when cap 102 has reached its full-closed position. (FIG. 3) When shoe cap 102 reaches the closed position, the latching rib 134 extends into a corresponding track or an extension of track 132 defined by shoe base 104 (FIG. 14).

Figure 3:
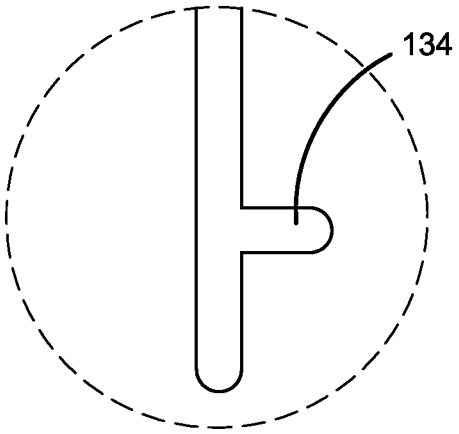
FIG. 3 is a section view taken along line D-D of FIG. 2B.
Figure 4:
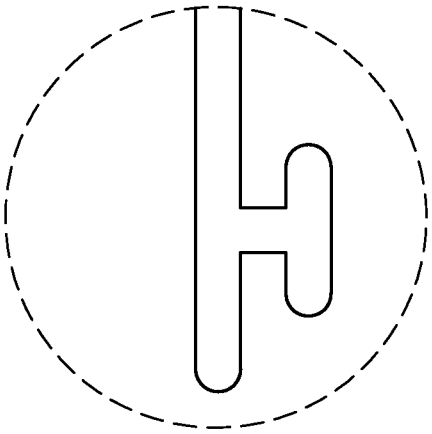
FIG. 4 is a section view showing an exemplary track.
Figure 6:
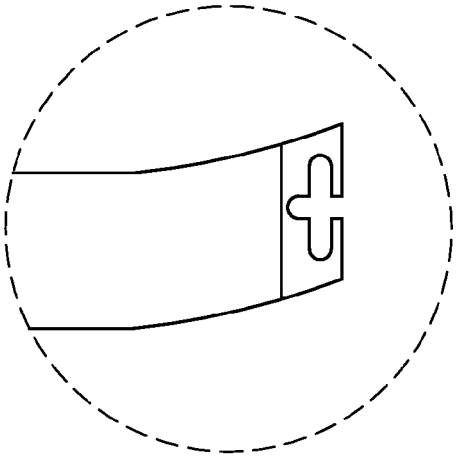
FIG. 6 is an enlarged view of the track from FIG. 9.
Figure 7:
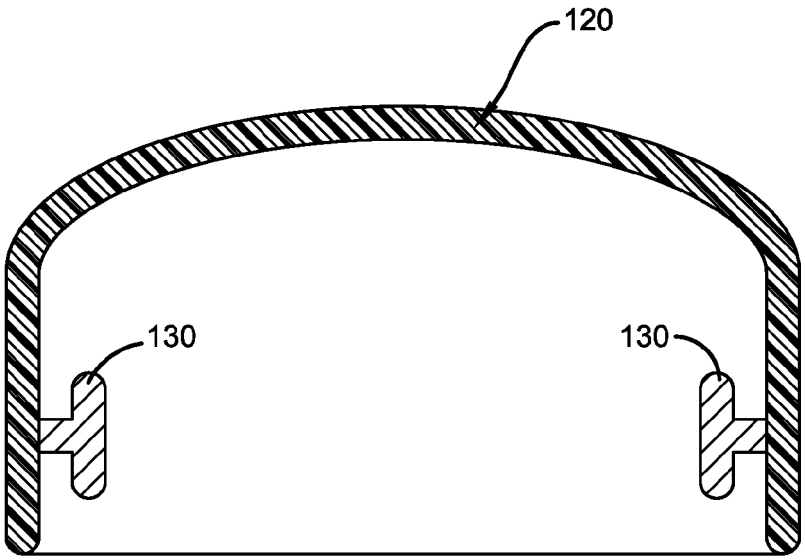
FIG. 7 is a section view taken along line E-E of FIG. 2A.

The Upper of the Shoe (The Cap):

The upper of a shoe 100 includes a body configured for covering the upper portion of the user's foot. As described above, the body may be in adjustable sizes. The track follower may be molded to become a single unit with the cap of the shoe (FIG. 7). The molded track follower 130 and rib 134 may extend from the left side to the front toe box and then back along the right side of the body of shoe cap 102. It will be no longer than required to slide into the mating track of shoe base 104. The toe box 106 of the shoe has an extended finger design (rib 134) that is different than the track follower 130 but is molded in a continuous line in the shoe (FIG. 3). The back end of the cap will contain a molded magnet 112 or other rear latching mechanism which aligns with a mating mechanism 114 in the base 104 of the shoe 100. This latching mechanism may be molded into the cap (FIG. 7). The shoe cap is extendable but not usually removable from the base and contains a stop that prevents it from extending and disengaging from the base (FIG. 5). The overall dimensions of the track follower 130 will be slightly smaller than the slot of track 132 to allow for a sliding motion to occur (FIG. 3, FIG. 4, and FIG. 6).

The cap can be made of a variety of different materials.

Figure 8:
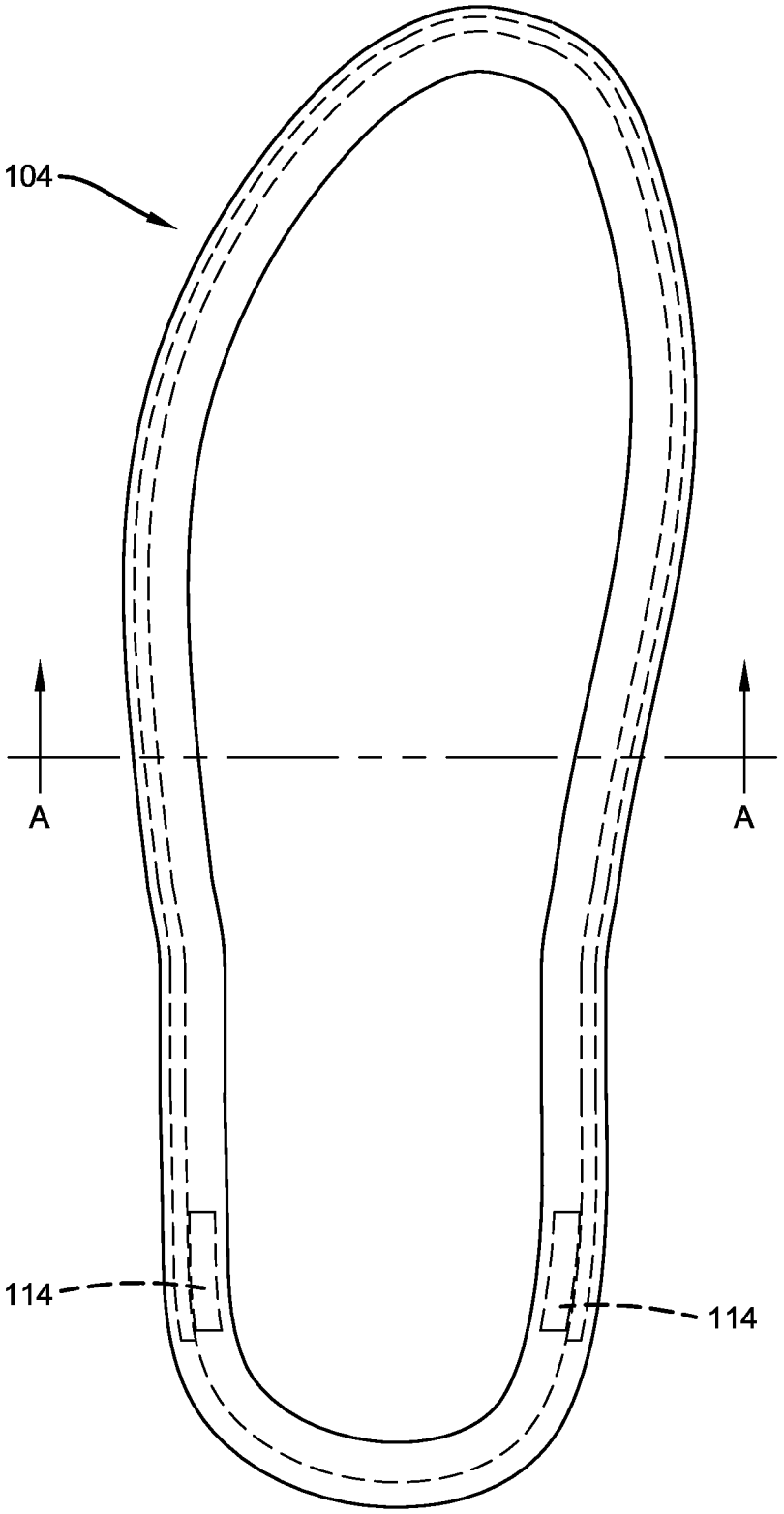
FIG. 8 is a top view of the shoe base.

The Base of the Shoe (The Base):

The base 104 of the shoe includes of all parts or sections of the shoe that form the sole and shoe sidewalls (FIG. 13). The base sidewalls are molded to include a track along the sides and front of the shoe to become a single unit with the base of the shoe (FIG. 6). This track shape is continuous around the sides and front of the shoe perimeter and forms a path from the left side base of the shoe around the front of the shoe and to the right side of the shoe. The track does not extend to the back of the shoe. The track has openings to accept track followers 130 from the attached shoe cap 102. In addition, the shoe base may include a magnetic or similar latching mechanism 114 at shoe rear to be used for locking the shoe cap 102 to the base 104 to prevent the cap 102 from loosening or to prevent ease in removal of the sliding cap (FIG. 8). This magnet 114 or rear latching mechanism may be molded into the base. The base can be made of a variety of different materials with preference given those materials which are synthetic and flexible and easily molded.

In the foregoing description, certain terms have been used for brevity, clearness, and understanding. No unnecessary limitations are to be implied therefrom beyond the requirement of the prior art because such terms are used for descriptive purposes and are intended to be broadly construed. Moreover, the above description and attached illustrations are an example and the invention is not limited to the exact details shown or described. Throughout the description and claims of this specification the words "comprise" and "include" as well as variations of those words, such as "comprises," "includes," "comprising," and "including" are not intended to exclude additives, components, integers, or steps.

The invention claimed is:

1. An item of footwear comprising:

first and second footwear portions that slide with respect to each other between open and closed conditions; the open condition allowing the user to don and remove the footwear; the first footwear portion being a shoe base that defines a full foot bed and the second footwear portion being a shoe cap selectively slidably carried over the shoe base between the open and closed conditions; the open condition of the shoe cap exposing a larger portion of the foot bed than when in the closed condition whereby a user can place a foot onto the foot bed when the cap is in the open condition and then slide the shoe cap over the shoe base and foot until the shoe cap reaches the closed condition;

the shoe base having a toe portion and a heel portion; the shoe cap covering the toe portion of the shoe base when the shoe cap is in the closed condition; and at least one of the first and second footwear portions including holding means for holding the footwear portion while the shoe cap is slid from the closed condition to the open condition thus allowing the user to open the footwear without requiring the user to bend over and manipulate closure mechanisms with his hands.

2. The footwear of claim 1, further comprising means for releasably latching the first and second footwear portions together in the closed condition.

3. The footwear of claim 1, wherein one of the first and second footwear portions defines a track and the other of the first and second footwear portions defines a track follower; the track follower moving in the track when the first and second footwear portions slide back and forth between the open and closed conditions.

4. An item of footwear comprising:

a shoe base that defines a foot bed sized for the entire foot; the foot bed adapted to receive the bottom of the entire foot; the shoe base having a heel portion and a toe portion;

a shoe cap slidably mounted to the shoe base and selectively slidable between open and closed conditions; the shoe cap covering the toe portion of the shoe base when the shoe cap is in the closed condition; the shoe cap adapted to cover the top of the front of the foot;

the shoe cap defining a toe box;

a magnet carried by the toe box of the shoe cap; the magnet adapted to secure the shoe cap to a stable item to allow the shoe cap to be moved from the closed condition to the open condition in a hands-free operation; and the open condition of the shoe cap exposing a majority of the foot bed of the shoe base allowing the user to readily place a foot on the foot bed and the closed condition of the shoe cap securing the foot on the foot bed.

5. The footwear of claim 4, wherein the entire foot bed is exposed when the shoe cap is in the open condition.

6. The footwear of claim 4, further comprising means for releasably latching the shoe cap to the shoe base.

7. The footwear of claim 4, further comprising a latching mechanism that releasably latches the shoe cap to the shoe base in the closed condition; the latching mechanism including magnets.

8. The footwear of claim 7, wherein magnets are disposed near or at a rear portion of the shoe cap and magnets are carried by the shoe base; the magnets on the shoe cap being secured to the magnets on the shoe base when the shoe cap is in the closed condition.

9. The footwear of claim 4, further comprising a latching mechanism that releasably latches the shoe cap to the shoe base in the closed condition; the latching mechanism including a mechanical force to hold the shoe cap in the closed condition.

10. The footwear of claim 4, wherein one of the shoe base and shoe cap includes a track defining a slot and the other of the shoe base and shoe cap includes a track follower; the track follower moving back and forth within the slot defined by the track.

11. The footwear of claim 10, further comprising a latching rib disposed on a front portion of the shoe cap; the latching rib being disposed in the track when shoe cap is in the closed condition.

12. A method of securing footwear to a foot comprising the steps of:

providing an item of footwear having a shoe base and a shoe cap; the shoe base defining a foot bed sized for the entire foot; the shoe base having a heel portion and a toe portion; and the shoe cap slidably mounted to the shoe base and selectively slidable between open and closed conditions; the shoe cap covering the toe portion of the shoe base when the shoe cap is in the closed condition;

moving one of the footwear shoe base and shoe cap with respect to the other of the footwear shoe base and shoe cap to slide the shoe cap to the open condition to expose a majority of the foot bed;

placing the foot on the foot bed; and sliding the shoe cap rearwardly to the closed condition after the foot is on the foot bed and latching the shoe cap to the shoe base to secure the footwear to the foot; the sliding and latching steps being accomplished in a hands-free operation.

13. The method of claim 12, wherein the step of moving further comprises the steps of magnetically connecting the shoe cap to a stable item to secure the position of the shoe cap while moving the shoe base rearwardly with respect to the shoe cap.

14. The method of claim 12, wherein the step of latching the shoe cap to the shoe base in the closed condition includes the step of magnetically joining the shoe cap to the shoe base together.

15. The method of claim 12, wherein the step of sliding the shoe cap rearwardly includes the step of moving a track follower along a track.

* * * * *